United States Patent [19]

Walker

[11] Patent Number: 4,896,424

[45] Date of Patent: Jan. 30, 1990

[54] COMPOSITE CUTTING BLADE AND METHOD OF MAKING THE BLADE

[76] Inventor: Michael L. Walker, 2343 Tros Rd., Taos, N. Mex. 87571

[21] Appl. No.: 299,549

[22] Filed: Jan. 13, 1989

[51] Int. Cl.[4] ..... B26B 9/00; B26B 3/06; B21K 11/00

[52] U.S. Cl. ..... 30/349; 30/161; 76/104 R

[58] Field of Search ..... 30/349, 357, 348, 349.5, 30/346.59, 161, 160; 76/104 R

[56] References Cited

U.S. PATENT DOCUMENTS

| | | | |
|---|---|---|---|
| 996,235 | 6/1911 | Fuller | 30/161 |
| 1,956,588 | 5/1934 | Parker et al. | 30/349 |
| 2,093,874 | 9/1937 | Stargardter | 76/104 R |
| 2,497,482 | 2/1950 | Wilson | 30/349 |

FOREIGN PATENT DOCUMENTS

| | | | |
|---|---|---|---|
| 3490 | of 1906 | United Kingdom | 30/160 |

*Primary Examiner*—Douglas D. Watts
*Assistant Examiner*—Paul M. Heyrana, Sr.
*Attorney, Agent, or Firm*—Charles C. Wells

[57] ABSTRACT

A new composite cutting blade for a knife or other cutting instrument and a novel method of making the blade. The blade is formed from a body section made of a strong tough material formed with a dovetail configuration along one edge thereof and a cutting edge section made of a hard durable material that has a matching dovetail configuraion along one edge. The body and cutting edge sections are joined by press fitting the two dovetail edges together and then peening the joint. The blade is provided with a recess so that when the blade is rotated into the handle that includes a unique locking means, the blade is retained in a closed position. The handle includes a liner that has a spring finger which engages the tang of the blade to lock the blade in an open position. The spring finger also has a ball detent mounted thereon that engages the recess in the blade when the blade is in a closed position so as to retain the blade in a tightly closed position.

5 Claims, 1 Drawing Sheet

COMPOSITE CUTTING BLADE AND METHOD OF MAKING THE BLADE

BACKGROUND OF THE INVENTION

1. Field of the Invention

This invention is in the field of cutting blades and more particularly it is in the field of blades for folding knives.

2. Description of the Prior Art

From time immemorial artisans and craftsmen have strived to develop better cutting blades. The goal has been to have a very strong blade but yet one which can be given a sharp and wear resistant cutting edge. Unfortunately metals which have characteristics that make for a strong blade do not provide the best cutting edges. There have been many approaches to overcoming this problem. For example, blades for circular saws are provided with carbide tips to improve their durability and cutting efficiency. Bi-metal band saw blades are provided with a hard wear resistant cutting edge by electron beam welding a harder tooth to a softer body. Other types of blades have also been made by adding a different material to a cutting blade by various types of welding and other metal depositing means and then grinding and polishing the blade to a desired configuration. While these prior methods may have accomplished their objectives they were not without disadvantages. The processes involved were time consuming, expensive and in many instances resulted in a finished product that was not aesthetically pleasing to the eye. Also there are some materials which are useful blade materials but not weldable.

SUMMARY OF THE INVENTION

A primary object of this invention is to provide a composite cutting blade that is strong and tough, has a hard wear resistant cutting edge and is aesthetically pleasing.

Another object of the invention is to provide an improved method of making a composite blade of materials that are not readily joined by welding.

Yet another object of the invention is to provide a cutting blade for a folding blade knife that can be securely retained in a closed position.

These and other objects of the invention are achieved by a knife blade composed of a body section and a cutting edge section that are each provided with matching dovetail edges so that the two blade sections can be assembled. The blade is provided with a hemispherical recess that is engaged by a ball detent in the knife locking mechanism when the blade is folded to a closed position, thereby retaining the blade in a tightly closed position in the handle of the knife.

DETAILED DESCRIPTION OF THE INVENTION

Figure 1:
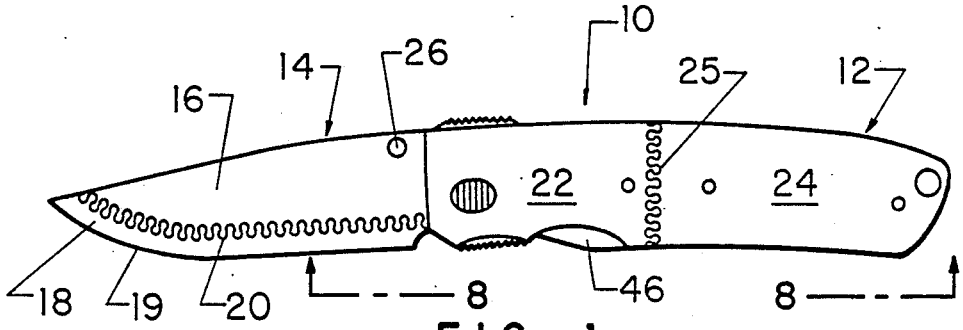
FIG. 1 is a view of a folding blade knife having a two section blade constructed in accordance with this invention.

FIG. 1 discloses a knife 10 having a handle 12 and a foldable composite blade 14 that is rotatably mounted for movement to an open and locked position. Blade 14 is composed of two sections, a body section 16 and a cutting edge section 18 that are joined by a running dovetail joint 20 having a circular configuration. Body section 16 is made of a metal such as, for example, 6 AL 4V titanium (RC 36) which results in a strong tough blade, but would not provide an optimum cutting edge. Cutting edge section 18 is made of CPM-T440V high carbon stainless steel (RC 62) which provides a hard, wear resistant cutting edge 19. Handle 12 is made up of a number of pins, thrust washers, bolsters and other parts which are not a part of this invention so they are not discussed or illustrated in detail herein. The handle includes two bolsters, one on each side, but only bolster 22 is shown in FIG. 1. Likewise there are two scales, but only scale 24 is shown in FIG. 1. Scale 24 and bolster 23 are joined by a slip fit running dovetail joint 25 so that the handle parts can be taken apart when desired. Blade 14 has a recess 26 formed therein which cooperates with a locking mechanism described hereafter.

Figure 2:
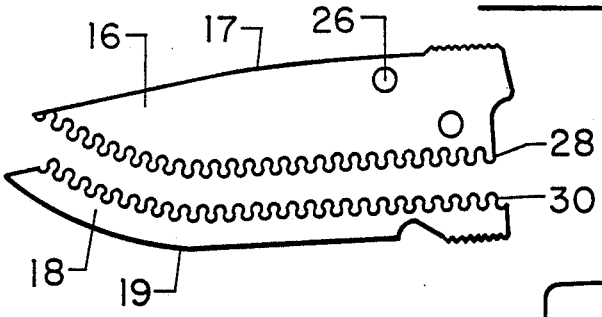
FIG. 2 is a view of a two part blade that illustrates the blade as it appears before assembly.

FIG. 2 illustrates the blade as it appears prior to assembly. Body section 16 has a smooth upper edge 17 and a running dovetail cut on lower edge 28 thereof. Upper edge 30 of cutting edge section 18 has a matching running dovetail cut therein. The dovetails are cut on a computer controlled wire electrical discharge machine. The dovetails can be cut to very accurate tolerances and the blade dovetails are cut with a friction fit so that they can be joined only by being pressed together. Lower edge 19 of cutting edge section 18 is a cutting edge. The bolster and scale dovetails are cut to a slip fit so that they can be assembled by hand. The blade sections are initially pressed together, or at least partially pressed together using a manually operated arbor press which is a well known tool for pressing devices together. The dovetail joint is then completed and riveted so as to permanently join the two sections by manually peening the joint. Peening of the joint with a hammer causes slight deformation or spreading of the metal in the area of the dovetail joint to make a permanent joint which is referred to herein as a riveted joint. When assembly is completed the blade is ground and polished to a desired finish. If desired other dovetail configurations, such as a squared shape, could be employed.

Figure 3:
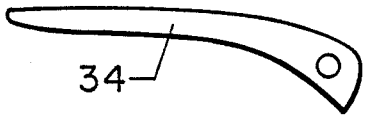
FIG. 3 is a view of a spacer that is employed in the handle of the knife.
Figure 4:
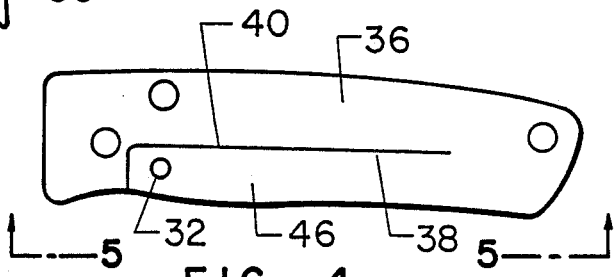
FIG. 4 is a side view of one of the two liners used in the knife handle and the liner includes an inwardly bent spring finger with a hemispherical ball detent mounted thereon.
Figure 7:
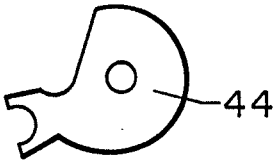
FIG. 7 is a view of one of two identical thrust washers used in the knife to facilitate the opening and closing thereof.
Figure 5:
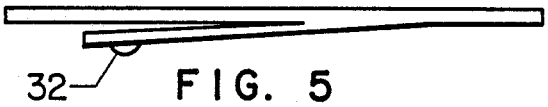
FIG. 5 is a view of the liner taken along lines 5—5 of FIG. 4.
Figure 6:
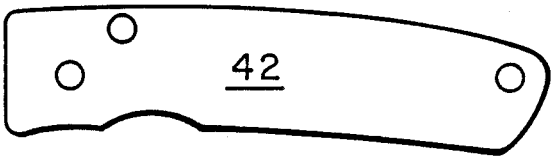
FIG. 6 is a side view of the other liner used in the handle.
Figure 9:
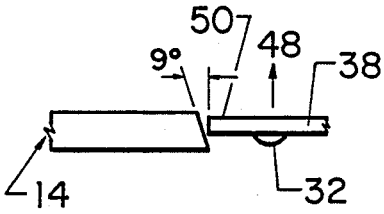
FIG. 9 illustrates a 9° angle on the tang of the blade which enhances the opening and closing of the knife.
Figure 8:
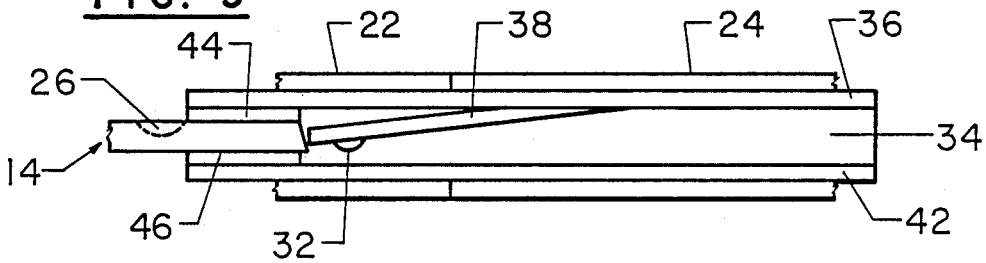
FIG. 8 is a view of an assembled knife with portions broken away and exaggerated dimensions so as to clearly illustrate how the spring finger and ball detent shown in FIGS. 4 and 5 can interact with the blade.

FIGS. 3–7 illustrate handle components which, with the exception of ball detent 32 shown in FIGS. 4 and 5, have been used on Applicant's knives for years so their construction and operation will not be described in great detail herein. FIG. 3 is a view of spacer 34 which is mounted between the two liners shown in FIGS. 4 and 6. The position of the spacer is also shown in FIG. 8. Liner 36, shown in FIGS. 4 and 8, has a spring finger portion 38 formed by splitting the liner along line 40 and then bending spring finger portion 38 inwardly in the direction illustrated in FIG. 8. The spring finger has a ball detent 32 mounted thereon which is biased into recess 26 in the blade by the spring action of spring finger 38 when the blade is moved to a closed position (not shown). Ball 32 is mounted in the spring by staking it into a hole formed in the spring. It could also be secured to the spring by a threaded connection or by making the ball integral with the spring. FIG. 6 illustrates liner 42 and the assembled position of the liner is shown in FIG. 9. FIG. 7 illustrates a thrust washer 44 and FIG. 8 shows how a thrust washer 44, and an identical thrust washer 46, are mounted on each side of blade 14.

The knife is not shown with the blade in a closed or folded position, but the operation of the knife is as follows, assuming the knife is open as shown in FIG. 1. Spring finger 38 is normally biased inwardly by spring action in a direction into the handle as shown. By manually pushing on spring finger 38 in the area indicated by the numeral 46 in FIGS. 1 and 4 spring finger 38 is moved in the direction of arrow 48 in FIG. 9 and away from the tang of the knife blade, to unlock the knife blade and permit rotation thereof to a closed position. As the blade rotates to a closed position the ball detent moves into recess 26 in the blade and retains the blade in a closed position. Note in FIG. 9 that the tang of the blade is cut at 9°. The purpose of the 9° angle on the tang is to make the locking mechanism self adjusting as it wears.

When the knife is new, end 50 of spring finger 38 engages the center of the tang. When wear occurs due to opening and closing of the knife the spring action of spring finger 38 will cause end 50 of the spring finger to be biased into the angled surface of the knife tang and maintain the locking mechanism in a tight condition. As is apparent from a consideration of FIG. 8, the spacing of the liner from the blade is such that the ball detent can be pushed out of the recess in the blade to permit opening of the knife.

This completes the description of a preferred embodiment of the invention. However it will be apparent to those skilled in the art, that some changes and modifications thereto may be made without departing from the spirit and scope of the invention as defined in the claims appended hereto. For example a dovetail configuration other than the one illustrated could be used in fabricating the knife. Also numerous blade materials other than those disclosed herein could be used, such as for example, carbide for the cutting edge section of the knife. Further, the direction of the spring action of the spring finger could be reversed by changing the bend direction of the spring and mounting the liner on the opposite side of the handle. By doing this and reversing the 9° angle on the tang of the blade the knife could be closed by manually pushing the spring finger in a direction opposite to that shown in the drawing. This would make it possible to provide either a right or left hand model for those persons who wanted to use only a finger or only a thumb to close or open the knife.

I claim:

1. A composite cutting blade for a folding blade knife comprising:

an elongated body means composed of a strong tough material which forms the load bearing member of said cutting blade, said body means having a smooth upper edge and a lower edge;

a dovetail formed in the lower edge of said elongated body means;

an elongated cutting edge means made of a hard wear resistant material for forming the cutting edge of said cutting blade, said cutting edge means having an upper edge and a lower cutting edge;

a dovetail formed in the upper edge of said cutting edge means that matches the dovetail in said elongated body means and is sized so as to be an interference fit with the dovetail in the lower edge of said elongated body means;

said elongated body means and said elongated cutting edge means being permanently joined together by press fitting the dovetailed edges together and peening the formed dovetail joint.

2. The cutting blade recited in claim 1 wherein said body means is 6 AL 4V titanium and said cutting edge means is CPM-T 44V high carbon stainless steel.

3. The cutting blade recited in claim 1 wherein a circular dovetail pattern is formed in the edges of said body and cutting edge means.

4. The cutting blade recited in claim 1 wherein the dovetail configuration formed in the edges of said body and cutting edge means are in a squared pattern.

5. A folding blade knife comprising:

a complete blade means having an elongated body section composed of a strong tough material that is the load bearing member of said blade means and an elongated cutting edge section composed of a hard wear resistant material shaped to a cutting edge;

said body section having an upper edge and a lower edge;

a dovetail formed in the lower edge of said body section;

said cutting edge section having an upper edge and a lower cutting edge;

a dovetail formed in the upper edge of said cutting edge section that matches the dovetail in said body section;

said body section and said cutting edge section being permanently joined together by press fitting the dovetailed edges together and peening the dovetailed joint;

a handle means in which said blade means is rotatably mounted;

manually releasable locking means mounted in said handle means that includes a liner means mounted so as to be positioned adjacent said blade means when said blade means is in a folded position, said liner means including a spring finger means having a ball detent mounted thereon that is biased against said blade when said blade is in a closed position; and said folding blade means having a hemispherical recess formed therein that is sized and positioned on the blade so that the recess receives the ball detent when the blade is folded, thereby securing the blade in a closed and protected position in said blade.

* * * * *